US008530379B2

(12) United States Patent
Shimizu et al.

(10) Patent No.: US 8,530,379 B2
(45) Date of Patent: Sep. 10, 2013

(54) THERMOSENSITIVE RECORDING MATERIAL AND PRODUCTION METHOD THEREOF

(75) Inventors: Kenji Shimizu, Shizuoka (JP); Shinji Okada, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 342 days.

(21) Appl. No.: 12/879,427

(22) Filed: Sep. 10, 2010

(65) Prior Publication Data

US 2011/0065575 A1 Mar. 17, 2011

(30) Foreign Application Priority Data

Sep. 14, 2009 (JP) ..... 2009-211820

(51) Int. Cl.
*B41M 5/42* (2006.01)

(52) U.S. Cl.
USPC ..... 503/226; 427/152

(58) Field of Classification Search
None
See application file for complete search history.

(56) References Cited

U.S. PATENT DOCUMENTS

| | | | |
|---|---|---|---|
| 5,866,504 | A | 2/1999 | Okada et al. |
| 5,985,791 | A | 11/1999 | Okada |
| 6,319,878 | B1 | 11/2001 | Ina et al. |
| 2002/0183202 | A1 | 12/2002 | Nagata et al. |
| 2008/0182749 | A1 | 7/2008 | Tohmatsu et al. |
| 2009/0215622 | A1 | 8/2009 | Okada et al. |

FOREIGN PATENT DOCUMENTS

| | | | |
|---|---|---|---|
| CN | 10011897 | A | 8/2007 |
| CN | 101352982 | A | 1/2009 |
| EP | 1254780 | A2 | 11/2002 |
| EP | 2093072 | A1 | 8/2009 |
| JP | 64-90792 | | 4/1989 |
| JP | 4-113888 | | 4/1992 |
| JP | 4-319485 | | 11/1992 |
| JP | 4-341889 | | 11/1992 |
| JP | 4-358887 | | 12/1992 |
| JP | 5-24350 | | 2/1993 |
| JP | 5-169811 | | 7/1993 |
| JP | 5-185721 | | 7/1993 |
| JP | 5-185738 | | 7/1993 |
| JP | 5-318937 | | 12/1993 |
| JP | 5-330232 | | 12/1993 |
| JP | 822620 | | 1/1996 |
| JP | 2585588 | | 12/1996 |
| JP | 2678358 | | 8/1997 |
| JP | 2679484 | | 8/1997 |
| JP | 2729255 | | 12/1997 |
| JP | 1044609 | | 2/1998 |
| JP | 1178243 | | 3/1999 |
| JP | 3463082 | | 8/2003 |
| JP | 2004-314329 | | 11/2004 |
| JP | 2006-82252 | | 3/2006 |
| JP | 2007-203608 | | 8/2007 |
| JP | 4125986 | | 5/2008 |
| WO | WO2008/139948 | | 11/2008 |

OTHER PUBLICATIONS

Oct. 26, 2010 European search report in connection with counterpart European patent application No. 10176408.
Chinese official action dated Aug. 28, 2012 in corresponding Chinese patent application No. 201010282220.

*Primary Examiner* — Bruce H Hess
(74) *Attorney, Agent, or Firm* — Cooper & Dunham LLP

(57) ABSTRACT

To provide a thermosensitive recording material, containing a base, a thermosensitive recording layer disposed on the base and containing a leuco dye and a color developer, an intermediate layer disposed on the thermosensitive recording layer, and a protective layer disposed on the intermediate layer, wherein the intermediate layer contains a resin, and an aziridine compound.

10 Claims, No Drawings

THERMOSENSITIVE RECORDING MATERIAL AND PRODUCTION METHOD THEREOF

BACKGROUND OF THE INVENTION

1. Field of the Invention

The present invention relates to a thermosensitive recording material (suitable for recording medical images), which uses a coloring reaction between an electron-donating coloring compound and an electron-accepting compound, and has excellent keeping quality of colored recorded images including half-tone images, and also relates to a method for producing such thermosensitive recording material.

2. Description of the Related Art

A thermosensitive recording matter has a thermosensitive recording layer on one surface of a base, where the thermosensitive recording layer contains a colorless or slightly colored coloring matter, such as an electron-donating leuco dye, an organic acid color developer such as an electron-accepting phenol compound, and a binder as main component, and the base is generally formed of paper, synthesized paper, or a plastic film. The coloring dye and the color developer are allowed to react by an application of thermal energy to thereby form a colored recording image.

Such thermosensitive recording matter has advantages such that a recording device used therefore is a compact and inexpensive, and maintenance thereof is easy. For these reasons, it has been widely used in the various fields, such as a recording material of electronic computers, facsimiles, ticket venders, scientific computers, CAD printers, plotters, and printers for CRT-based medical measurements.

Moreover, because of problems in processing of waste liquid cased by a wet process of a silver X-ray film as well as digitalization of images, in recent years, there have been demands for a dry film system which easily output, especially in the medical field. Along with such trend, a thermosensitive recording film usable for the medical field has been also desired because of easiness of the thermosensitive recording process.

A thermosensitive recording material for medical use is generally classified into a transmitting thermosensitive recording material which is translucent and uses such translucency, and a reflective thermosensitive recording material which has extremely low or no translucency, and uses the reflected light to view a formed image thereon.

In the case where the thermosensitive recording material for medical use is the reflective type, a synthesized paper having a multilayer structure is used because such thermosensitive recording material needs to achieve the required properties, such as water resistance, sufficient tensile strength, uniformity of recorded images, high resolution, size stability, and thin line recording ability.

Medical images have images of low to high color density ranges, and especially the keeping quality of a coloring image of half tone is important. Moreover, it is also desired that a recording color density is high, coloring tone is in pure black in all density ranges, and image do not discolor or fade by influences of light, heat, and moisture.

In Japanese Patent Application Laid-Open (JP-A) No. 05-318937, for stably preserving recording images of half tone, there is proposed a thermosensitive recording material, which contain, on a base, a thermosensitive recording layer containing a colorless or slightly tinted base dye and a coloring agent configured to develop a color in contact with the dye, and an intermediate layer containing a water-soluble resin or water-dispersible resin, and an overcoat layer containing an ionizing radiation-curable resin, where the thermosensitive recording layer contains, as the coloring agent, at least one salicylic acid derivative expressed by the following general formula (1) or a polyvalent metal salt thereof, and at least one phenol derivative expressed by the following general formula (2):

General Formula (1)

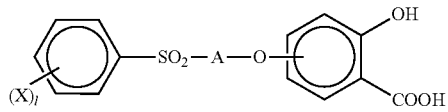

General Formula (2)

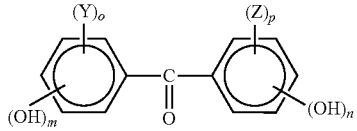

However, this thermosensitive recording material has a problem such that materials usable as a coloring agent are limited.

In JP-A No. 2004-314329, there is proposed a thermosensitive recording material which contains, on a base, a color reversible thermosensitive recording layer containing generally a colorless or slightly tinted dye precursor and a reversible color developer capable of reversibly changing a color tone of the dye precursor, an oxygen-barrier layer containing at least one water-soluble polymer selected from the group consisting of alkoxysilane having an amino group and/or imino group, alkoxysilane having an epoxy group, and an aziridine compound, and a protective layer, disposed in this order.

However, it is not sure whether such thermosensitive recording material has an effect on keeping quality of half tone or not.

In JP-A No. 2007-203608, a thermosensitive recording material having improved water resistance and the like is proposed. In this thermosensitive recording material, a polyamine or polyamide resin in combination with an epichlorohydrin resin is added to an intermediate layer provided between a recording layer and a protective layer.

However, this thermosensitive recording material requires both the epichlorohydrin resin and the polyamine or polyamide resin having functional groups interactive with the pichlorohydrin resin. In addition, whether or not this thermosensitive recording material provides an effect of preserving half tone images is uncertain.

Moreover, such thermosensitive recording material is proposed in JP-A Nos. 05-024350, 05-169811, 05-185721, and 05-330232 that it contains a thermosensitive recording layer to which certain aziridine is added for improving keeping quality. However, there is a possibility that aggregations of aziridine may be caused if the reactivity of the aziridine is excessively high. Therefore, this thermosensitive recording material has a problem such that aziridine usable therein is limited to the aziridine compound having a low reactivity can be used.

BRIEF SUMMARY OF THE INVENTION

The present invention aims at solving various problems in the art, and achieving the following object. Namely, the object of the present invention is to provide a thermosensitive recording material, which is a reflection thermosensitive recording material an image formed by which is seen with reflection light, and has excellent keeping quality of half tone, and also to provide a method for producing such thermosensitive recording material.

As a result of the diligent studies and researches conducted by the present inventors for achieving the aforementioned object, the present inventors have found that keeping quality of a half tone can be improved by providing an intermediate layer containing a resin and a crosslinking agent between a thermosensitive recording layer and a protective layer, and adding a certain additive to the thermosensitive recording layer or intermediate layer. The present invention has been made based upon such finding by the present inventors.

Means for solving the aforementioned problem is as follows:

<1> A thermosensitive recording material, containing:

a base;

a thermosensitive recording layer disposed on the base, and containing a leuco dye and a color developer;

an intermediate layer disposed on the thermosensitive recording layer; and a protective layer disposed on the intermediate layer, wherein the intermediate layer contains a resin, and an aziridine compound.

<2> The thermosensitive recording material according to <1>, wherein the intermediate layer further contains a polyamine resin, or polyamide resin, or both thereof.

<3> The thermosensitive recording material according to any of <1> or <2>, wherein the resin contains polyvinyl alcohol.

<4> The thermosensitive recording material according to any one of <1> to <3>, wherein the thermosensitive recording layer further contains at least one selected from the group consisting of a polyamine resin and a polyamide resin.

<5> The thermosensitive recording material according to any one of <1> to <4>, wherein the aziridine compound contains at least two functional groups per molecule.

<6> The thermosensitive recording material according to any one of <1> to <5>, wherein an amount of the aziridine compound in the intermediate layer is 15 parts by mass to 30 parts by mass relative to 100 parts by mass of the resin contained in the intermediate layer.

<7> The thermosensitive recording material according to any one of <1> to <6>, wherein an amount of the polyamine resin, or the polyamide resin, or both thereof in the intermediate layer is 10 parts by mass to 40 parts by mass relative to 100 parts by mass of the resin contained in the intermediate layer.

<8> The thermosensitive recording material according to any one of <3> to <7>, wherein the polyvinyl alcohol is carboxylic acid-modified polyvinyl alcohol.

<9> The thermosensitive recording material according to any one of <1> to <8>, wherein the leuco dye in the thermosensitive recording layer contains a black coloring leuco dye, a red coloring leuco dye, and a blue coloring leuco dye.

<10> The thermosensitive recording material according to any one of <1> to <9>, wherein the protective layer contains a resin containing an acrylate resin which is cured by UV or electron beam radiation.

<11> The thermosensitive recording material according to any one of <1> to <10>, further containing a back layer.

<12> A method for producing a thermosensitive recording material, containing:

applying an intermediate layer coating liquid containing an ammonium aqueous solution so as to form an intermediate layer, wherein the thermosensitive recording material is the thermosensitive recording material as defined in any one of <1> to <11>.

The present invention solves the various problems in the art, achieves the aforementioned object, and provides a thermosensitive recording material which is a reflective thermosensitive recording material an image formed by which is seen with reflection light, and has excellent keeping quality of a half tone, as well as a method of producing such thermosensitive recording material.

DETAILED DESCRIPTION OF THE INVENTION

The present invention will be specifically explained hereinafter.

(Thermosensitive Recording Material)

The thermosensitive recording material of the present invention contains at least a base, a thermosensitive recording layer formed on the base, an intermediate layer formed on the thermosensitive recording layer, and a protective layer formed on the intermediate layer, and may further contain a back layer, if necessary.

<Intermediate Layer>

The intermediate layer contains at least a resin, and an aziridine compound, and optionally contains either an aziridine compound or a polyamine-amide resin, or both thereof, and a surfactant.

In the present specification, the "aziridine compound" means an aziridine group (ethylene imine group) containing compound.

It is assumed that the aziridine compound functions not only to crosslink the resin, but also to correlate with a color developer or a leuco dye contained in the thermosensitive recording layer, which will be explained later. Owing to this correlation, the intermediate color in the formed image is stably maintained.

The aziridine compound functions to suppress a change in a color density of an image due to humidity, and the polyamine-amide resin functions to suppress a change in a color tone of an image due to light.

—Resin—

The resin used in the intermediate layer is suitably selected depending on the intended purpose without any restriction. Examples thereof include: ordinal polyvinyl alcohol; modified polyvinyl alcohol such as amino group-modified polyvinyl alcohol, and epoxy-modified polyvinyl alcohol; starch and derivatives thereof cellulose derivatives such as hydroxymethyl cellulose, hydroxyethyl cellulose, carboxymethyl cellulose, and methyl cellulose ethyl cellulose; water-soluble polymers such as sodium polyacrylate, polyvinyl pyrrolidone, acrylamide-acrylate copolymer, acrylamide-acrylate-methacrylate terpolymer, alkali salt of styrene-maleic anhydride copolymer, alkali salt of isobutylene-maleic anhydride copolymer, polyacryl amide, sodium alginate, gelatin, and casein; emulsions of polyvinyl acetate, polyurethane, polyacrylic acid, polyacrylate, vinyl chloride-vinyl acetate copolymer, polybutyl methacrylate, ethylene-vinyl acetate copolymer, or the like; and latex of styrene-butadiene copolymer, styrene-butadiene-acryl copolymer or the like. Among them, the carboxylic acid-modified polyvinyl alcohol is preferable, as the resulting thermosensitive recording material will have both the maximum fading density, and the maximum coloring density of the medium color (half tone) at a desirable balance through a change with time. In the case where a coating liquid of the protective layer, which will be applied onto the intermediate layer is a solvent-based liquid, a resin having high resistance to the solvent is preferably used as the resin.

—Aziridine Compound—

The aziridine compound for used in the intermediate layer is suitably selected depending on the intended purpose without any restriction. Specific examples thereof include those presented below:

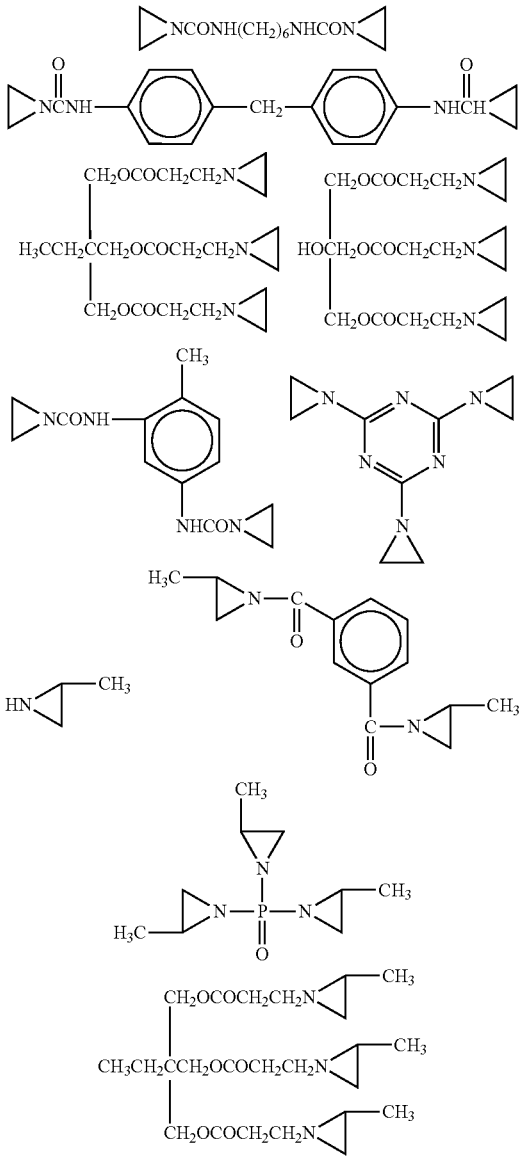

Among them, an aziridine compound having two or more aziridine groups is preferable, because it can crosslink the resin (i.e., it can function as a crosslinking agent). The toxicity of the aziridine compound reduces as it crosslinks with the resin.

An amount of the aziridine compound for use is suitably selected depending on the intended purpose without any restriction, but it is preferably 15% by mass to 30% by mass relative to the amount of the resin.

In view of the keeping quality of the image, the larger the amount of the aziridine compound is more preferable. However, if the amount thereof is excessively large, a coloring sensitivity of the resulting thermosensitive recording material reduces.

When the aziridine compound and the polyvinyl alcohol resin serving as the aforementioned resin are mixed, the mixed liquid clouds with time, which will be a problem in light of the stability of the liquid. In such case, an ammonium aqueous solution is added to the mixed liquid to adjust the pH value of the liquid to 7 or higher, thereby stabilizing the aziridine compound. This can slow down the process of clouding.

—Polyamine Resin and Polyamide Resin—

The polyamine resin and polyamide resin for used in the intermediate layer are suitably selected depending on the intended purpose without any restriction. Examples thereof include a modified polyamine resin, and a modified polyamide resin.

The modified polyamine resin is suitably selected depending on the intended purpose without any restriction. Examples thereof include SUMIREZ RESIN SPI-102A (manufactured by Sumitomo Chemical Co., Ltd.), PA6634 (manufactured by Seiko PMC Corporation), PA6644 (manufactured by Seiko PMC Corporation), PA6646 (manufactured by Seiko PMC Corporation), PA6650 (manufactured by Seiko PMC Corporation), PA6656 (manufactured by Seiko PMC Corporation), DK6800 (manufactured by Seiko PMC Corporation), DK6802 (manufactured by Seiko PMC Corporation), DK6810 (manufactured by Seiko PMC Corporation), DK6850 (manufactured by Seiko PMC Corporation), DK6852 (manufactured by Seiko PMC Corporation), and DK6854 (manufactured by Seiko PMC Corporation).

The modified polyamide resin is suitably selected depending on the intended purpose without any restriction. Examples thereof include SUMIREZ RESIN SPI-203(50)H (manufactured by Sumitomo Chemical Co., Ltd.), SUMIREZ RESIN SPI-106N (manufactured by Sumitomo Chemical Co., Ltd.), SUMIREZ RESIN 633 (manufactured by Sumitomo Chemical Co., Ltd.), SI6400 (manufactured by Seiko PMC Corporation), SI6402 (manufactured by Seiko PMC Corporation), WS4002 (manufactured by Seiko PMC Corporation), WS4020 (manufactured by Seiko PMC Corporation), WS4024 (manufactured by Seiko PMC Corporation), WS4030 (manufactured by Seiko PMC Corporation), and WS4052 (manufactured by Seiko PMC Corporation).

An amount of the polyamine resin and/or polyamide resin for use is suitably selected depending on the intended purpose without any restriction, but it is preferably 0.10% by mass to 0.40% by mass relative to the amount of the resin.

In view of the keeping quality of the image, the larger the amount of the polyamine resin and/or polyamide resin is more preferable. However, if the amount thereof is excessively large, a coloring sensitivity of the resulting thermosensitive recording material reduces.

A coating method of the intermediate layer is suitably selected depending on the intended purpose without any restriction. For example, the intermediate layer is coated by a conventional method.

A thickness of the intermediate layer is suitably selected depending on the intended purpose without any restriction, but it is preferably 1 μm to 5 μm, more preferably 1 μm to 2 μm. When the thickness of the intermediate layer is less than 1 μm, the resulting intermediate layer may have insufficient functions, such as water resistance, chemical resistance, and the like. When the thickness thereof is more than 5 μm, the thermal sensitivity of the resulting thermosensitive recording material reduces, and it is also disadvantageous in terms of cost.

—Intermediate Layer Coating Liquid—

The intermediate layer coating liquid is suitably selected depending on the intended purpose without any restriction, provided that it contains the resin, either the aziridine compound or the polyamine-amide resin, or both thereof, but it preferably contains an ammonium aqueous solution. By adding the ammonium aqueous solution to the intermediate layer coating liquid, a pH value thereof can be adjusted to more than 7 (i.e., the intermediate layer coating liquid is adjusted to be alkaline). Note that, the amount of the ammonium aqueous solution is preferably as large as possible.

Use of NaOH or $Ca(OH)_2$ may be also effective, but these substances are remained in the coating film as solids, which may adversely affect the printing characteristics of the resulting recording material. Therefore, use of these substances is not preferable.

<Thermosensitive Recording Layer>

The thermosensitive recording layer is suitably selected depending on the intended purpose without any restriction, provided that it contains a leuco dye, and a color developer as main components. The thermosensitive recording layer may further contain auxiliary additives such as a preservative, a water-soluble polymer and/or aqueous resin emulsion, filler, a thermoplastic material, a surfactant, and a binder, if necessary.

—Leuco Dye—

The leuco dye is suitably selected depending on the intended purpose without any restriction. Examples thereof include leuco dyes commonly used in this type of thermosensitive materials. Among them, leuco compounds such as triphenyl methane dyes, fluoran dyes, phenothiazine dyes, auramine dyes, spiropyran dyes, and indolino-phthalide dyes are preferable.

The leuco dye for use in the thermosensitive recording material for recording medical images contains at least one black coloring leuco dye, at least one red coloring leuco dye, and at least one blue coloring leuco dye.

The total amount of the red coloring leuco dye and the blue coloring leuco dye is suitably selected depending on the intended purpose without any restriction, but it is preferably 5% by mass to 10% by mass relative to the total amount of the leuco dye.

The black coloring leuco dye is suitably selected depending on the intended purpose without any restriction. Examples thereof include fluoran dyes such as 3-(N-ethyl-p-toluidino)-6-methyl-7-anilinofluoran, 3-diethylamino-6-methyl-7-anilinofluoran, 3-(N-methyl-N-cyclohexyl)amino-6-methyl-7-anilinofluoran, 3-dibutylamino-7-chloroanilinofluoran, 3-diethylamino-7-(methatrifluoromethyl)anilinofluoran, 3-(N-ethyl-N-tetrahydrofurfuryl)amino-6-methyl-7-anilinofluoran, 3-(N-ethyl-N-isopentyl)amino-6-methyl-7-anilinofluoran, and 3-(N,N-dibutyl)amino-6-methyl-7-anilinofluoran. These may be used independently or in combination.

Among them, 3-(N-ethylp-toluidino)-6-methyl-7-anilinofluoran is preferable.

The red coloring leuco dye is suitably selected depending on the intended purpose without any restriction. Examples thereof include 3-diethylamino-6-methyl-7-chlorofluoran, rhodamine-B-o-chloroanilino lactam, and 3,6-bis(diethylamino)fluoran-γ-(4'-nitro)anilinolactam, 6-diethylamino-benzofluoran. There may be used independently or in combination.

Among them, the dye (melting point: 175° C.) expressed by the following formula (1), as it does not easily cause fading of the color thereof by light.

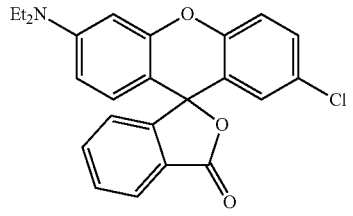

(1)

The blue coloring leuco dye is suitably selected depending on the intended purpose without any restriction, but it is preferably the dye (melting point: 180° C.) expressed by the following formula (2), as it provides a high coloring density with a small amount thereof.

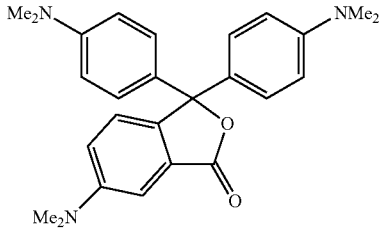

(2)

—Color Developer—

The color developer is suitably selected depending on the intended purpose without any restriction, provided that it is selected from various electron-accepting compounds capable of coloring the leuco dye. Examples thereof include a phenol compound, an organic acid compound, an inorganic acid compound, esters thereof, and salts thereof.

Specific examples of the color developer include gallic acid, salicylic acid, 3-isopropyl salicylate, 3-cyclohexyl salicylate, 3,5-di-tert-butyl salicylate, 3,5-di-α-methylbenzyl salicylate, 4,4'-isopropylidene diphenol, 1,1'-isopropylidene bis(2-chlorophenol), 4,4'-isopropylidene bis(2,6-dibromophenol), 4,4'-isopropylidene bis(2,6-dichlorophenol), 4,4'-isopropylidene bis(2-methylphenol), 4,4'-isopropylidene bis(2,6-dimethylphenol), 4,4'-isopropylidene bis(2-tert-butylphenol), 4,4'-sec-butylidene diphenol, 4,4'-cyclohexylidene bisphenol, 4,4'-cyclohexylidene bis(2-methylphenol), 4-tert-butylphenol, 4-phenylphenol, 4-hyroxydiphenoxide, α-naphthol, 6-naphthol, 3,5-xylenol, thymol, methyl-4-hydroxybenzoate, 4-hydroxyacetophenone, Novolak phenol resin, 2,2'-thiobis(4,6-dichlorophenol), catechol, resorcin, hydrochinone, pyrogallol, fluoroglycine, fluoroglycine carboxylic acid, 4-tert-octylcatechol, 2,2'-methylene bis(4-chlorophenol), 2,2'-methylene bis(4-methyl-6-tert-butylphenol), 2,2,-dihydroxydiphenyl, ethyl p-hydroxy benzoate, propyl p-hydroxy benzoate, butyl p-hydroxy benzoate, benzyl p-hydroxy benzoate, p-chlorobenzyl-p-hydroxy benzoate, o-chlorobenzyl-p-hydroxy benzoate, p-methyl benzyl-p-hydroxy benzoate, n-octyl-p-hydroxy benzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, bis(4-hydroxyphenyl)sulfide, 2-hydroxy-p-toluic acid, zinc 3,5-di-tert-butyl salicylate, tin 3,5-di-tert-butyl salicylate, tartaric acid, oxalic acid, maleic acid, citric acid, succinic acid, stearic acid, 4-hydroxy phthalic acid, boric acid, thiourea derivatives, 4-hydroxythiophenol derivatives, bis(4-hydroxyphenyl) acetic acid, ethyl bis(4-hydroxyphenyl)acetate, n-propyl bis(4-hydroxyphenyl)acetate, m-butyl bis(4-hydroxyphenyl)acetate, phenyl bis(4-hydroxyphenyl)acetate, benzyl bis(4-hydroxyphenyl)acetate, phenethyl bis(4-hydroxyphenyl)acetate, bis(3-methyl-4-hydroxyphenyl) acetic acid, methyl bis(3-methyl-4-hydroxyphenyl) acetate, n-propyl bis(3-methyl-4-hydroxyphenyl)acetate, 1,7-bis(4-hydroxyphenylthio)-3,5-dioxaheptane, 1,5-bis(4-hydroxyphenylthio)-3-oxaheptane, dimethyl-4-hydroxyphthalate, 4-hydroxy-4'-methoxydiphenyl sulfone, 4-hydroxy-4'-ethoxydiphenyl sulfone, 4-hydroxy-4'-isopropoxydiphenyl sulfone, 4-hydroxy-4'-propoxydiphenyl sulfone, 4-hydroxy-4'-butoxydiphenyl sulfone, 4-hydroxy-4'-isobutoxydiphenyl sulfone, 4-hydroxy-4-butoxydiphenyl sulfone, 4-hydroxy-4'-tert-butoxydiphenyl sulfone, 4-hydroxy-4'-benzyloxydiphenyl sulfone, 4-hydroxy-4'-phenoxydiphenyl sulfone, 4-hydroxy-4'-(m-methylbenzyloxy) diphenyl sulfone, 4-hydroxy-4'-(p-methylbenzyloxy) diphenyl sulfone, 4-hydroxy-4'-(o-methylbenzyloxy) diphenyl sulfone, 4-hydroxy-4'-(p-chlorobenzyloxy) diphenyl sulfone, and bis-(3-allyl-4-hydroxyphenyl)-sulfone. These may be used independently or in combination.

Among them, 4-hydroxy-4'-isopropoxydiphenyl sulfone is preferable, as it can provide desirable coloring density and coloring tone when it is used in combination with the black coloring dye of 3-(N-ethyl-p-toluidino)-6-methyl-7-anilinofluoran.

—Preservation Stabilizer—

The preservation stabilizer is suitably selected depending on the intended purpose without any restriction. Examples thereof include conventional preservation stabilizers.

Among them, 1,1,3-tris(2-methyl-4-hydroxy-5-cyclohexylphenyl) butane is preferable, as it can improve the keeping quality of recorded images (i.e. heat resistance, and humidity resistance of recorded images) when it is used in combination of the color developer of 4-hydroxy-4'-isopropoxydiphenyl sulfone.

—Filler—

The filler is suitably selected depending on the intended purpose without any restriction. Examples thereof include: inorganic powders such as powders of calcium carbonate, silica, zinc oxide, aluminum hydroxide, zinc hydroxide, barium sulfate, clay, talc, surface-treated potassium, and surface-treated silica; and organic powders such as powders of urea-formalin resin, styrene-methacrylate copolymer, and polystyrene resin.

—Thermoplastic Material—

The thermoplastic material is suitably selected depending on the intended purpose without any restriction. Examples thereof include: higher fatty acid and esters thereof; amide and metal salts thereof various wax; condensation products of aromatic carboxylic acid and amine; phenyl benzoate; higher straight-chain glycol; dialkyl-3,4-epoxy-hexahydrophthalate, higher ketone; p-benzylbiphenyl; and a thermofusion organic compound having a melting point of about 50° C. to 200° C.

Specific examples thereof include: fatty acids such as stearic acid, and behenic acid; fatty acid amides such as stearic acid amide, and palmitic acid amide; fatty acid metal salts such as zinc stearate, aluminum stearate, calcium stearate, zinc palmitate, and zinc behenate; and others such as p-benzylbiphenyl, m-terphenyl, triphenyl methane, benzyl p-benzyloxy benzoate, β-benzyloxy naphthalene, phenyl β-naphthoate, phenyl 1-hydroxy-2-naphthoate, methyl 1-hydroxy-2-naphthoate, diphenyl carbonate, glycol carbonate, dibenzyl terephthalate, dimethyl terephthalate, 1,4-dimethoxy naphthalene, 1,4-diethoxy naphthalene, 1,4-dibenzoxy naphthalene, 1,2-diphenoxy ethane, 1,2-bis(3-methylphenoxy)ethane, 1,2-bis(4-methylphenoxy)ethane, 1,4-diphenoxy-2-butane, 1,4-diphenoxy-2-butene, 1,2-bis(4-methoxyphenylthio)ethane, dibenzoyl methane, 1,4-diphenylthiobutane, 1,4-diphenylthio-2-butene, 1,3-bis(2-vinyloxyethoxy)benzene, 1,4-bis(2-vinyloxyethoxy) benzene, p-(2-vinyloxyethoxy)biphenyl, p-aryloxybiphenyl, p-propargyloxybiphenol, dibenzoyloxymethane, benzoyloxypropane, dibenzyldisulfide, 1,1-diphenyl ethanol, 1,1-diphenyl propanol, p-benzyloxybenzyl alcohol, 1,3-phenoxy-2-propanol, N-octadecylcarbamyl-p-methoxycarbonyl benzene, N-octadecyl carbamoyl benzene, 1,2-bis(4-methoxyphenoxy)propane, 1,5-bis(4-methoxyphenoxy)-3-oxapentane, dibenzyl oxalate, bis(4-methylbenzyl) oxalate, and bis (4-chlorobenzyl) oxalate. The thermoplastic material can also used as a sensitizer.

—Binder—

The binder is suitably selected depending on the intended purpose without any restriction, provided that it combines and supports the leuco dye and the color developer on the base. Examples thereof include: polyvinyl alcohol; starch and derivatives thereof; cellulose derivatives such as hydroxymethyl cellulose, hydroxyethyl cellulose, carboxymethyl cellulose, methyl cellulose, and ethyl cellulose; water-soluble polymers such as polyacrylate soda, polyvinyl pyrrolidone, acryl amide-acrylic acid ester copolymers, acryl amide-acrylic acid ester-methacrylic acid terpolymers, alkali salts of styrene-maleic anhydride copolymers, alkali salts of isobutylene-maleic anhydride copolymers, polyacryl amide, alginate soda, gelatin and casein; emulsions such as emulsions of polyvinyl acetate, polyurethane, polyacrylic acid, polyacrylate, vinyl chloride-vinyl acetate copolymer, polybutyl methacrylate, and ethylene-vinylacetate copolymer; latex such as latex of styrene-butadiene copolymer, styrene-butadiene-acryl copolymer.

The formation method of the thermosensitive recording layer is suitably selected depending on the intended purpose without any restriction. For example, it can be formed by uniformly dispersing or dissolving the leuco dye and the color developer together with the binder resin to form a coating liquid, and applying and drying the coating liquid onto the base.

The coating method of the thermosensitive recording layer is suitably selected depending on the intended purpose without any restriction. Examples thereof include die-fountain coating, wire-bar coating, gravure coating, and air knife coating.

Among them, the die-fountain coating is preferable, as it provides a uniform coating layer, and can coat the coating layer without touching the base.

The glossiness (GS (75°)) of the thermosensitive recording layer defined in JIS-P-8142 is suitably selected depending on the purpose without any restriction, but it is preferably 40% or higher for attaining images of high gloss, and high density, and dot-reproducibility during printing.

The volume average particle diameter of dispersed products in the coating liquid of the thermosensitive recording layer is suitably selected depending on the intended purpose without any restriction. It is preferably 2.0 μm or less, more preferably 1.0 μm or less, as the resulting thermosensitive recording layer can attain the glossiness (GS (75°)) defined in JIS-P-8142 of 40% or higher.

A thickness of the thermosensitive recording layer is suitably selected depending on the intended purpose (e.g. compositions of the thermosensitive recording layer, intended use of the thermosensitive recording material, and the like) without any restriction. It is preferably in the approximate range of 1 μm to 50 μm, more preferably in the approximate range of 3 μm to 20 μm.

Other than the resin as the binder, the thermosensitive recording layer may contain polyamine or polyamide resin as an additive, for further improving the keeping quality of recorded images.

<Base>

The base is suitably selected depending on the intended purpose without any restriction, but it is preferably a synthesized paper having a multilayer structure, formed of a polyolefine resin and a white inorganic pigment.

On the base, the aforementioned thermosensitive recording layer is formed.

<Protective Layer>

The protective layer is provided on the thermosensitive recording layer for improving the matching with a thermal head or the like, and improving keeping quality of a recorded image.

A resin for forming the protective layer is suitably selected depending on the intended purpose without any restriction. Examples thereof include: water-soluble resins such as polyvinyl alcohol, cellulose derivatives, starch and derivatives thereof, carboxyl group-modified polyvinyl alcohol, polyacrylic acid and derivatives thereof, styrene-acrylic acid copolymer and derivatives thereof, poly(meth)acrylamide and derivatives thereof, styrene-acrylic acid-acrylamide copolymer, amino group-modified polyvinyl alcohol, epoxy-modified polyvinyl alcohol, polyethylene imine, aqueous polyester, aqueous polyurethane, and isobutylene-maleic anhydride copolymer and derivatives thereof; acrylate polymers which can be cured by UV or electron beam radiation.

Among these, the acrylate polymers which can cured by UV or electron beam radiation are preferable, as it improves water resistance, chemical resistance, and glossiness of the protective layer.

By improving the glossiness of the protective layer, the maximum coloring density of the thermosensitive recording medium improves, to thereby provide an image which has a further enhanced tone.

The protective layer may contains, other than the aforementioned resin, conventional auxiliary additives such as filler, a surfactant, a thermoplastic material (or a lubricant), and a pressure-coloring inhibitor, and may further contain a water-proof agent. In this case, specific examples of the filler and the thermoplastic material are those listed in the description of the thermosensitive recording layer.

A coating method of the protective layer is suitably selected depending on the intended purpose without any restriction. Examples thereof include conventional coating methods.

A thickness of the protective layer is suitably selected depending on the intended purpose without any restriction, but it is preferably 0.1 μm to 20 μm, more preferably 0.5 μm to 10 μm. When the thickness of the protective layer is less than 0.1 μm, the resulting protective layer has insufficient functions such as protection capability for a recording medium, and heat-matching properties. When the thickness thereof is more than 20 μm, a thermal sensitivity of the resulting thermosensitive recording material reduces, and it is also disadvantageous in terms of cost.

<Back Layer>

The back layer is formed on the back surface of the base, and is a layer containing a matting agent formed of particles. The back layer reduces carling of the thermosensitive recording material, and presents the thermosensitive recording layer from being closely contact with other members, to thereby improve a transferring performance by an imager during recording.

When the matting agent is formed of inorganic particles, the resulting back layer tends to be scratched by frictions. However, when the matting agent is formed of organic particles, the resulting back layer is less likely scratched by friction.

The resin particles are suitably selected depending on the intended purpose without any restriction. Examples thereof include particles of a crosslinked polystyrene resin, a urea-formalin resin, a silicone resin, a crosslinked polymethacrylate-methyl acrylate resin, and melamine-formaldehyde resin. The average particle diameter of the resin particles is suitably selected depending on the intended purpose without any restriction, but it is preferably 5 μm to 20 μm, more preferably 10 μm to 15 μm.

When the average particle diameter of the resin particles is less than 5 μm, the obtainable effect of close contact reduces. When the average particle diameter thereof is more than 20 μm, raised portions can be observed on a surface of the back layer, which degrades an appearance of the thermosensitive recording material.

An amount of the resin particles for use is suitably selected depending on the intended purpose without any restriction, but it is preferably 0.5% by mass to 10% by mass, more preferably 1% by mass to 5% by mass relative to the amount of the resin contained in the back layer.

When the amount of the resin particles is less than 0.5% by mass, the obtainable effect of close contact reduces. When the amount thereof is more than 10% by mass, a transparency of the back layer may be impaired.

Moreover, it is preferred that the back layer contain a conducting agent for the purpose of preventing the back layer from being charged.

The conducting agent is suitably selected depending on the intended purpose without any restriction. Examples thereof include anionic conducting agents, such as sodium polystyrene sulfonate, ammonium polystyrene sulfonate, sodium polyacrylate, and ammonium polyacrylate.

EXAMPLES

The present invention will be more specifically explained through Examples hereinafter, but the Examples shall not be construed as limiting the scope of the present invention in any way. Note that, "part(s)" and "%" presented below are all bass basis, unless otherwise mentioned.

Example 1

1. Base

The base for use was a synthesized paper having a multilayer structure consisted of five layers, having a thickness of 188±5 μm, surface glossiness of 95%, smoothness of 11,000 seconds, and having a strength of 400 mN in the machine direction (MD) and 600 mN in the cross direction (CD).

2. Preparation of a Thermosensitive Recording Layer Coating Liquid

| [Dye Dispersion Liquid A] | |
|---|---|
| 2-anilino-3-methyl-6-(di-n-butylamino)fluoran | 20 parts |
| 10% carboxylic acid-modified polyvinyl alcohol (product name: Kuraray K Polymer KL-318, manufacturer: Kuraray Co., Ltd.) solution | 20 parts |
| Water | 60 parts |

The above-presented ingredients were each pulverized by a magnetic ball mill to thereby obtain Dye Dispersion Liquid A having an average particle diameter of 0.8 μm.

| [Color Developer Dispersion Liquid] | |
|---|---|
| Bis-(3-allyl-4-hydroxyphenyl)-sulfone | 12 parts |
| Silica (product name: MIZUKASIL P-603, manufacturer: Mizusawa Industrial Chemicals, Ltd.) | 4 parts |
| Stearic acid amide | 4 parts |
| 10% carboxylic acid-modified polyvinyl alcohol (product name: Kuraray K Polymer KL-318, manufacturer: Kuraray Co., Ltd.) solution | 20 parts |
| Water | 60 parts |

The above-presented ingredients were each pulverized by a magnetic ball mill to thereby obtain Color Developer Dispersion Liquid having an average particle diameter of 0.9 μm.

| [Thermosensitive Recording Layer Coating Liquid A] | |
|---|---|
| Dye Dispersion Liquid A | 12.5 parts |
| Color Developer Dispersion Liquid | 62.5 parts |
| 10% carboxylic acid-modified polyvinyl alcohol (product name: Kuraray K Polymer KL-318, manufacturer: Kuraray Co., Ltd.) solution | 25 parts |

The above-presented components were mixed in the ratio shown above, to thereby obtain Thermosensitive Recording Layer Coating Liquid A.

Thermosensitive Recording Layer Coating Liquid A was applied onto the base (the base film) by a wire bar, and passed through a dryer keeping the temperature at 50° C. for 3 minutes for drying, to thereby form Thermosensitive Recording Layer A having a thickness of 8.5 g/m$^2$.

3. Preparation of Intermediate Layer Coating Liquid

| [Intermediate Layer Coating Liquid A] | |
|---|---|
| 1-(2-hydroxyethyl)ethylene imine (aziridine compound) | 1 part |
| 10% polyvinyl alcohol (product name: Kuraray K Polymer KL-117, manufacturer: Kuraray Co., Ltd.) solution | 50 parts |
| Water | 49 parts |

The above-presented ingredients were mixed in the ratio shown above, to thereby prepare Intermediate Layer Coating Liquid A.

Intermediate Layer Coating Liquid A was applied onto Thermosensitive Recording Layer A by a wire bar, and passed through a dryer keeping the temperature at 50° C. for 2 minutes for drying, to thereby form Intermediate Layer A having a thickness of 1.5 g/m$^2$.

4. Preparation of Protective Layer Coating Liquid

| [Filler Dispersion Liquid] | |
|---|---|
| Calcium carbonate (product name: Brilliant-15, manufacturer: Shiraiwa Kogyo Co., Ltd.) | 20 parts |
| 10% carboxylic acid-modified polyvinyl alcohol (product name: Kuraray K Polymer KL-318, manufacturer: Kuraray Co., Ltd.) solution | 20 parts |
| Water | 60 parts |

The above-presented ingredients were each pulverized by a magnetic ball mill to thereby prepare a filler dispersion liquid having a volume average particle diameter of 0.3 μm.

| [Protective Layer Coating Liquid A] | |
|---|---|
| Acryl emulsion (product name: Barrier Star B2000, manufacturer: Mitsui Chemicals Inc., solid content: 20%) | 42 parts |
| Zinc stearate emulsion (product name: K-994, manufacturer: Chukyo Yushi Co., Ltd., volume average particle diameter: 0.2 μm, solid content: 20%) | 6 parts |
| Filler dispersion liquid (volume average particle diameter: 0.3 μm) | 7 parts |
| Water | 43 parts |
| 2,2-bishydroxymethylbutanol-tris[3-(1-aziridinyl)propynate] (aziridine compound) (product name: CHEMITITE PZ-33, manufacturer: Nippon Shokubai Co., Ltd.) | 2 parts |

The above-presented ingredients were mixed in the ratio shown above, to thereby prepare a protective layer coating liquid.

The protective layer coating liquid was applied onto Intermediate Layer A by a wire bar, and passed through a dryer keeping the temperature at 70° C. for 3 minutes for drying, to thereby form a protective layer having a thickness of 3.0 g/m$^2$. In this manner, a thermosensitive recording material of Example 1 was formed.

Example 2

| [Intermediate Layer Coating Liquid B] | |
|---|---|
| 1-(2-hydroxyethyl)ethylene imine (aziridine compound) | 0.8 parts |
| Modified polyamine resin (product name: PA6650, manufacturer: Seiko PMC Corporation, solid content: 60%) | 2.0 parts |
| 10% polyvinyl alcohol (product name: Kuraray K Polymer KL-117, manufacturer: Kuraray Co., Ltd.) solution | 40.0 parts |
| Water | 57.2 parts |

The above-presented ingredients were mixed in the ratio shown above, to thereby prepare Intermediate Layer Coating Liquid B.

A thermosensitive recording material of Example 2 was prepared in the same manner as in Example 1, provided that Intermediate Layer Coating Liquid A was replaced with Intermediate Layer Coating Liquid B.

Example 3

| [Thermosensitive Recording Layer Coating Liquid B] | |
|---|---|
| Dye Dispersion Liquid A | 12.5 parts |
| Color Developer Dispersion Liquid | 62.5 parts |
| 10% carboxylic acid-modified polyvinyl alcohol (product name: Kuraray K Polymer KL-318, manufacturer: Kuraray Co., Ltd.) solution | 24.3 parts |
| Modified polyamine resin (product name: PA6650, manufacturer: Seiko PMC Corporation, solid content: 60%) | 0.7 parts |

The above-presented components were mixed in the ratio shown above, to thereby obtain Thermosensitive Recording Layer Coating Liquid B.

A thermosensitive recording material of Example 3 was prepared in the same manner as in Example 1, provided that Thermosensitive Recording Layer Coating Liquid A was replaced with Thermosensitive Recording Layer Coating Liquid B.

Example 4

| [Intermediate Layer Coating Liquid C] | |
|---|---|
| 2,2-bishydroxymethylbutanol-tris[3-(1-aziridinyl)propionate] (referred to as Aziridine Compound A hereinafter)(product name: CHEMITITE PZ-33, manufacturer: Nippon Shokubai Co., Ltd.) | 1 part |
| 10% polyvinyl alcohol (product name: Kuraray K Polymer KL-117, manufacturer: Kuraray Co., Ltd.) solution | 50 parts |
| Water | 49 parts |

The above-presented ingredients were mixed in the ratio shown above, to thereby prepare Intermediate Layer Coating Liquid C.

A thermosensitive recording material of Example 4 was prepared in the same manner as in Example 1, provided that Intermediate Layer Coating Liquid A was replaced with Intermediate Layer Coating Liquid C.

Example 5

| [Intermediate Layer Coating Liquid D] | |
|---|---|
| Aziridine Compound A | 0.8 parts |
| Modified polyamine resin (product name: PA6650, manufacturer: Seiko PMC Corporation, solid content: 60%) | 2.0 parts |
| 10% polyvinyl alcohol (product name: Kuraray K Polymer KL-117, manufacturer: Kuraray Co., Ltd.) solution | 40.0 parts |
| Water | 57.2 parts |

The above-presented ingredients were mixed in the ratio shown above, to thereby prepare Intermediate Layer Coating Liquid D.

A thermosensitive recording material of Example 5 was prepared in the same manner as in Example 1, provided that Intermediate Layer Coating Liquid A was replaced with Intermediate Layer Coating Liquid D.

Reference Example 6

| [Intermediate Layer Coating Liquid E] | |
|---|---|
| Modified polyamine resin (product name: PA6650, manufacturer: Seiko PMC Corporation, solid content: 60%) | 2.3 parts |
| 10% polyvinyl alcohol (product name: Kuraray K Polymer KL-117, manufacturer: Kuraray Co., Ltd.) solution | 46.2 parts |
| Water | 51.5 parts |

The above-presented ingredients were mixed in the ratio shown above, to thereby prepare Intermediate Layer Coating Liquid E.

A thermosensitive recording material of Reference Example 6 was prepared in the same manner as in Example 1, provided that Intermediate Layer Coating Liquid A was replaced with Intermediate Layer Coating Liquid E.

Example 7

| [Intermediate Layer Coating Liquid F] | |
|---|---|
| Aziridine Compound A (product name: CHEMITITE PZ-33, manufacturer: Nippon Shokubai Co., Ltd.) | 1.4 parts |
| 10% polyvinyl alcohol (product name: Kuraray K Polymer KL-117, manufacturer: Kuraray Co., Ltd.) solution | 46.1 parts |
| Water | 52.5 parts |

The above-presented ingredients were mixed in the ratio shown above, to thereby prepare Intermediate Layer Coating Liquid F.

A thermosensitive recording material of Example 7 was prepared in the same manner as in Example 1, provided that Intermediate Layer Coating Liquid A was replaced with Intermediate Layer Coating Liquid F.

Example 8

| [Intermediate Layer Coating Liquid G] | |
|---|---|
| Aziridine Compound A (product name: CHEMITITE PZ-33, manufacturer: Nippon Shokubai Co., Ltd.) | 0.8 parts |
| 10% polyvinyl alcohol (product name: Kuraray K Polymer KL-117, manufacturer: Kuraray Co., Ltd.) solution | 52.2 parts |
| Water | 47.0 parts |

The above-presented ingredients were mixed in the ratio shown above, to thereby prepare Intermediate Layer Coating Liquid G.

A thermosensitive recording material of Example 8 was prepared in the same manner as in Example 1, provided that Intermediate Layer Coating Liquid A was replaced with Intermediate Layer Coating Liquid G.

Reference Example 9

| [Intermediate Layer Coating Liquid H] | |
|---|---|
| Modified polyamine resin (product name: PA6650, manufacturer: Seiko PMC Corporation, solid content: 60%) | 2.8 parts |
| 10% polyvinyl alcohol (product name: Kuraray K Polymer KL-117, manufacturer: Kuraray Co., Ltd.) solution | 42.9 parts |
| Water | 54.3 parts |

The above-presented ingredients were mixed in the ratio shown above, to thereby prepare Intermediate Layer Coating Liquid H.

A thermosensitive recording material of Reference Example 9 was prepared in the same manner as in Example 1, provided that Intermediate Layer Coating Liquid A was replaced with Intermediate Layer Coating Liquid H.

Reference Example 10

| [Intermediate Layer Coating Liquid I] | |
|---|---|
| Modified polyamine resin (product name: PA6650, manufacturer: Seiko PMC Corporation, solid content: 60%) | 0.9 parts |
| 10% polyvinyl alcohol (product name: Kuraray K Polymer KL-117, manufacturer: Kuraray Co., Ltd.) solution | 54.5 parts |
| Water | 44.6 parts |

The above-presented ingredients were mixed in the ratio shown above, to thereby prepare Intermediate Layer Coating Liquid I.

A thermosensitive recording material of Reference Example 10 was prepared in the same manner as in Example 1, provided that Intermediate Layer Coating Liquid A was replaced with Intermediate Layer Coating Liquid I.

Example 11

A thermosensitive recording material of Example 11 was prepared in the same manner as in Example 1, provided that the 10% polyvinyl alcohol (product name: Kuraray K Polymer KL-117, manufacturer: Kuraray Co., Ltd.) solution used in Intermediate Layer Coating Liquid A prepared in Example 1 was replaced with 10% carboxylic acid-modified polyvinyl alcohol (product name: Kuraray K Polymer KL-318, manufacturer: Kuraray Co., Ltd.).

Example 12

| [Intermediate Layer Coating Liquid J] | |
|---|---|
| Aziridine Compound A | 0.8 parts |
| Modified polyamine resin (product name: PA6650, manufacturer: Seiko PMC Corporation, solid content: 60%) | 2.0 parts |

-continued

| [Intermediate Layer Coating Liquid J] | |
|---|---|
| Ammonium water (ammonium content: 29%) | 0.4 parts |
| 10% polyvinyl alcohol (product name: Kuraray K Polymer KL-318, manufacturer: Kuraray Co., Ltd.) solution | 39.2 parts |
| Water | 57.6 parts |

The above-presented ingredients were mixed in the ratio shown above, to thereby prepare Intermediate Layer Coating Liquid J.

A thermosensitive recording material of Example 12 was prepared in the same manner as in Example 1, provided that Intermediate Layer Coating Liquid A was replaced with Intermediate Layer Coating Liquid J.

Example 13

| [Dye Dispersion Liquid B] | |
|---|---|
| Material of the following formula (1) (melting point: 175° C.) | 20 parts |
| 10% carboxylic acid-modified polyvinyl alcohol (product name: Kuraray K Polymer KL-318, manufacturer: Kuraray Co., Ltd.) solution | 20 parts |
| Water | 60 parts |

(1)

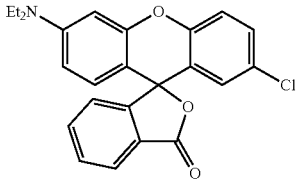

The above-presented ingredients were each pulverized by a magnetic ball mill to thereby obtain Dye Dispersion Liquid B having an average particle diameter of 0.8 μm.

| [Dye Dispersion Liquid C] | |
|---|---|
| Material of the following formula (2) (melting point: 180° C.) | 20 parts |
| 10% carboxylic acid-modified polyvinyl alcohol (product name: Kuraray K Polymer KL-318, manufacturer: Kuraray Co., Ltd.) solution | 20 parts |
| Water | 60 parts |

(2)

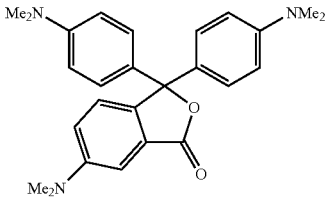

The above-presented ingredients were each pulverized by a magnetic ball mill to thereby obtain Dye Dispersion Liquid C having an average particle diameter of 0.8 μm.

| [Thermosensitive Recording Layer Coating Liquid C] | |
|---|---|
| Dye Dispersion Liquid A | 11.25 parts |
| Dye Dispersion Liquid B | 0.75 parts |
| Dye Dispersion Liquid C | 0.5 parts |
| Color developer dispersion liquid | 62.5 parts |
| 10% carboxylic acid-modified polyvinyl alcohol (product name: Kuraray K Polymer KL-318, manufacturer: Kuraray Co., Ltd.) solution | 25 parts |

The above-presented ingredients were mixed in the ratio shown above, to thereby obtain Thermosensitive Recording Layer Coating Liquid C.

A thermosensitive recording material of Example 13 was prepared in the same manner as in Example 1, provided that Thermosensitive Recording Layer Coating Liquid A was replaced with Thermosensitive Recording Layer Coating Liquid C prepared above, and Intermediate Layer Coating Liquid A was replaced with Intermediate Layer Coating Liquid J prepared in Example 12.

Reference Example 14

| [Protective Layer Coating Liquid B] | |
|---|---|
| Polyester acrylate resin (product name: M9050, manufacturer: Toagosei Co., Ltd.) | 50 parts |
| Photopolymerization initiator (product name: IRGACURE 184, manufacturer: BASF Japan Ltd.) | 4 parts |
| Silicone filler (product name: KMP590, manufacturer: Shin-Etsu Chemical Co., Ltd.) | 5 parts |
| Ethyl acetate | 41 parts |

The above-presented ingredients were mixed in the ratio shown above, to thereby obtain Protective Layer Coating Liquid B.

A thermosensitive recording material of Reference Example 14 was prepared in the same manner as in Example 1, provided that Thermosensitive Recording Layer Coating Liquid A was replaced with Thermosensitive Recording Layer Coating Liquid C prepared in Example 13, Protective Layer Coating Liquid A was replaced with Protective Layer Coating Liquid B above, and ultraviolet rays (365 nm, 400 mJ/cm$^2$) was applied to cure the resin after applying and drying Thermosensitive Recording Layer C, Intermediate Layer Coating Liquid J and Protective Layer Coating Liquid B in the same manner as in Example 1.

Comparative Example 1

| [Intermediate Layer Coating Liquid K] | |
|---|---|
| 10% polyvinyl alcohol (product name: Kuraray K Polymer KL-117, manufacturer: Kuraray Co., Ltd.) solution | 60 parts |
| Water | 40 parts |

The above-presented ingredients were mixed in the ratio shown above, to thereby prepare Intermediate Layer Coating Liquid K.

A thermosensitive recording material of Comparative Example 1 was prepared in the same manner as in Example 1, provided that Intermediate Layer Coating Liquid A was replaced with Intermediate Layer Coating Liquid K prepared above.

Example 15

| [Intermediate Layer Coating Liquid L] | |
|---|---|
| 1-(2-hydroxyethyl)ethylene imine (aziridine compound) | 3 parts |
| 10% polyvinyl alcohol (product name: Kuraray K Polymer KL-117, manufacturer: Kuraray Co., Ltd.) solution | 53 parts |
| Water | 44 parts |

The above-presented ingredients were mixed in the ratio shown above to prepare Intermediate Layer Coating Liquid L.

A thermosensitive recording material of Example 15 was prepared in the same manner as in Example 1, provided that Intermediate Layer Coating Liquid A was replaced with Intermediate Layer Coating Liquid L prepared above.

Example 16

| [Intermediate Layer Coating Liquid M] | |
|---|---|
| Aziridine Compound A (product name: CHEMITITE PZ-33, manufacturer: Nippon Shokubai Co., Ltd.) | 3 parts |
| 10% polyvinyl alcohol (product name: Kuraray K Polymer KL-117, manufacturer: Kuraray Co., Ltd.) solution | 53 parts |
| Water | 44 parts |

The above-presented ingredients were mixed in the ratio shown above to prepare Intermediate Layer Coating Liquid M.

A thermosensitive recording material of Example 16 was prepared in the same manner as in Example 1, provided that Intermediate Layer Coating Liquid A was replaced with Intermediate Layer Coating Liquid M.

Example 17

| [Intermediate Layer Coating Liquid N] | |
|---|---|
| Aziridine Compound A (product name: CHEMITITE PZ-33, manufacturer: Nippon Shokubai Co., Ltd.) | 1 part |
| 10% polyvinyl alcohol (product name: Kuraray K Polymer KL-117, manufacturer: Kuraray Co., Ltd.) solution | 67 parts |
| Water | 32 parts |

The above-presented ingredients were mixed in the ratio shown above to prepare Intermediate Layer Coating Liquid N.

A thermosensitive recording material of Example 17 was prepared in the same manner as in Example 1, provided that Intermediate Layer Coating Liquid A was replaced with Intermediate Layer Coating Liquid N.

Example 18

| [Intermediate Layer Coating Liquid O] | |
|---|---|
| Aziridine Compound A (product name: CHEMITITE PZ-33, manufacturer: Nippon Shokubai Co., Ltd.) | 1 part |
| 10% carboxylic acid-modified polyvinyl alcohol (product name: Kuraray K Polymer KL-318, manufacturer: Kuraray Co., Ltd.) solution | 67 parts |
| Water | 32 parts |

The above-presented ingredients were mixed in the ratio shown above to prepare Intermediate Layer Coating Liquid O.

A thermosensitive recording material of Example 18 was prepared in the same manner as in Example 1, provided that Intermediate Layer Coating Liquid A was replaced with Intermediate Layer Coating Liquid O.

Example 19

| [Intermediate Layer Coating Liquid P] | |
|---|---|
| Aziridine Compound A (product name: CHEMITITE PZ-33, manufacturer: Nippon Shokubai Co., Ltd.) | 1.3 parts |
| Ammonium aqueous solution (29%) | 0.7 parts |
| 10% carboxylic acid-modified polyvinyl alcohol (product name: Kuraray K Polymer KL-318, manufacturer: Kuraray Co., Ltd.) solution | 65 parts |
| Water | 33 parts |

The above-presented ingredients were mixed in the ratio shown above to prepare Intermediate Layer Coating Liquid P.

A thermosensitive recording material of Example 19 was prepared in the same manner as in Example 1, provided that Intermediate Layer Coating Liquid A was replaced with Intermediate Layer Coating Liquid P.

Example 20

A thermosensitive recording material of Example 20 was prepared in the same manner as in Example 1, provided that Thermosensitive Recording Layer Coating Liquid A was replaced with Thermosensitive Recording Layer Coating Liquid C prepared in Example 13, and Intermediate Layer Coating Liquid A was replaced with Intermediate Layer Coating Liquid P prepared in Example 19.

Example 21

A thermosensitive recording material of Example 21 was prepared in the same manner as in Example 1, provided that Thermosensitive Recording Layer Coating Liquid A was replaced with Thermosensitive Recording Layer Coating Liquid C prepared in Example 13, Intermediate Layer Coating Liquid A was replaced with Intermediate Layer Coating Liquid P prepared in Example 19, Protective Layer Coating Liquid A was replaced with Protective Layer Coating Liquid B prepared in Example 14, and ultraviolet rays (365 nm, 400 mJ/cm$^2$) were applied to cure the resin after applying and drying Thermosensitive Recording Layer Coating Liquid C, Intermediate Layer Coating Liquid P and Protective Layer Coating Liquid B in the same manner as in Example 1.

Various physical properties of the samples prepared in Examples, Reference Examples and Comparative Example were evaluated in the following manners.

1. Light Resistance

On each thermosensitive recording material, an image having a gradation of 16 color tones (reflective densities varying from a background density to $D_{max}$) was printed by means of an energy changeable horizon (manufactured by Codonics Inc.) equipped with a gradation head having a resolution of 300 dpi. Initial color tone values (a*, b*) of the image were measured by TD-904 manufactured by GretagMacbeth.

After measuring the initial tone value of the image, the image was then exposed to light of 7,000 lux (a light source: 3 wavelengths daylight-colored lamp, manufactured by Toshiba Lighting and Technology Corporation) for 24 hours under the environment having temperature of 23° C. and humidity of 50% RH. Thereafter, the color tone of the image, which had been exposed to the aforementioned environment, was measured by TD-904 manufactured by GretagMacbeth.

The change in the color tone (i.e., color difference) (ΔE) was obtained as an absolute value calculated from "the change in the color tone ΔE=the color tone value after exposure E−the initial color tone value E." Note that, E was calculated by the formula: $E=\sqrt{(a^{*2}+b^{*2})}$.

The maximum color tone change ΔEmax was determined among the gradation of 16 color tones, and evaluated based on the following criteria.

[Evaluation Criteria]

A: ΔEmax was 2.0 or less

B: ΔEmax was more than 2.0, but 3.0 or less

C: ΔEmax was more than 3.0

2. Moisture Resistance

On each thermosensitive recording material, an image having a gradation of 16 color tones (reflective densities varying from a background density to $D_{max}$) was printed by means of an energy changeable horizon (manufactured by Codonics Inc.) equipped with a gradation head having a resolution of 300 dpi. Initial color density of the image was measured by TD-904 manufactured by GretagMacbeth.

After measuring the initial color density of the image, the image was stored in a high temperature-high humidity storage set at the temperature of 40° C. and the humidity of 90% RH for 24 hours. Thereafter, the optical density of the image, which had been stored, was measured by TD-904 manufactured by GretagMacbeth.

The change in value was obtained as an absolute value calculated from "the change in value=the color density after storage−the initial color density."

The change in the color density was determined as the maximum value ΔODmax among the gradation of 16 color tones, where ΔODmax was the total of the change in the value related to fading, and the change in the value related to coloring. The results were evaluated based on the following criteria.

[Evaluation Criteria]

A: ΔODmax was 0.30 or less.

B: ΔODmax was more than 0.30, but 0.50 or less.

C: ΔODmax was more than 0.50.

3. Maximum Coloring Density (ODmax Value)

On each thermosensitive recording material, an image having a gradation of 16 color tones (reflective densities varying from a background density to $D_{max}$) was printed by means of an energy changeable horizon (manufactured by Codonics Inc.) equipped with a gradation head having a resolution of 300 dpi. The density of each tone in the image was measured by TD-904 manufactured by GretagMacbeth.

The maximum coloring density Dmax was measured, and evaluated based on the following criteria.

[Evaluation Criteria]

A: 2.00 or more

B: 1.90 or more, but less than 2.00

C: 1.80 or more, but less than 1.90

D: Less than 1.80

4. Stability of Intermediate Layer Coating Liquid

The time required from the preparation of Intermediate Layer

Coating Liquid to occurrence of clouding in Intermediate Layer Coating Liquid of each thermosensitive recording material was measured, and the results were evaluated based on the following criteria.

[Evaluation Criteria]

A: 6 hours or longer

B: Longer than 30 minutes, but shorter than 6 hours

C: 30 minutes or shorter

5. Color Tone

On each thermosensitive recording material, an image having a gradation of 16 color tones (reflective densities varying from a background density to $D_{max}$) was printed by means of an energy changeable horizon (manufactured by Codonics Inc.) equipped with a gradation head having a resolution of 300 dpi. Each color tone in the image was measured by TD-904 manufactured by GretagMacbeth. The color tone of the image was measured as the values of a* and b* in the optical density range (OD value range) of 0 to 1.5, and the results were evaluated based on the following criteria.

[Evaluation Criteria]

A: $-4<a^*<+4$, $-4<b^*<+4$ with the OD value being from 0 to 1.5

B: $-8<a^*<+8$, $-8<b^*<+8$ with the OD value being from 0 to 1.5

C: $a^*\leqq-8$, $a^*\geqq8$, $b^*\leqq-8$, $b^*\geqq8$ with the OD value being from 0 to 1.5

6. Water Resistance and Chemical Resistance

A droplet of 70% isopropyl alcohol was dropped on the protective layer of each thermosensitive recording material, and the time required for the thermosensitive recording layer to start coloring was measured. The results were evaluated based on the following criteria.

[Evaluation Criteria]

A: 10 minutes or longer

B: 5 minutes or longer, but shorter than 10 minutes

C: Shorter than 5 minutes

1. Light Resistance

TABLE 1

| | Δ Emax | Evaluation |
|---|---|---|
| Ex. 1 | 2.89 | B |
| Ex. 2 | 1.72 | A |
| Ex. 3 | 1.62 | A |
| Ex. 4 | 2.56 | B |
| Ex. 5 | 1.70 | A |
| Ref. Ex. 6 | 1.66 | A |
| Ex. 7 | 2.25 | B |
| Ex. 8 | 2.44 | B |
| Ref. Ex. 9 | 1.26 | A |
| Ref. Ex. 10 | 1.98 | A |
| Ex. 11 | 1.50 | A |

TABLE 1-continued

| | Δ Emax | Evaluation |
|---|---|---|
| Ex. 12 | 1.51 | A |
| Ex. 13 | 1.60 | A |
| Ref. Ex. 14 | 1.62 | A |
| Comp. Ex. 1 | 4.13 | C |
| Ex. 15 | 2.80 | B |
| Ex. 16 | 2.10 | B |
| Ex. 17 | 2.47 | B |
| Ex. 18 | 2.45 | B |
| Ex. 19 | 2.50 | B |
| Ex. 20 | 2.43 | B |
| Ex. 21 | 2.20 | B |

2. Moisture Resistance

TABLE 2

| | Change in fading | Change in coloring | Total change | Evaluation |
|---|---|---|---|---|
| Ex. 1 | 0.45 | 0.03 | 0.48 | B |
| Ex. 2 | 0.32 | 0.03 | 0.35 | B |
| Ex. 3 | 0.30 | 0.02 | 0.32 | B |
| Ex. 4 | 0.22 | 0.01 | 0.23 | A |
| Ex. 5 | 0.19 | 0.01 | 0.20 | A |
| Ref. Ex. 6 | 0.32 | 0.04 | 0.36 | B |
| Ex. 7 | 0.13 | 0.02 | 0.15 | A |
| Ex. 8 | 0.26 | 0.03 | 0.29 | A |
| Ref. Ex. 9 | 0.30 | 0.02 | 0.32 | B |
| Ref. Ex. 10 | 0.37 | 0.03 | 0.40 | B |
| Ex. 11 | 0.10 | 0.10 | 0.20 | A |
| Ex. 12 | 0.11 | 0.10 | 0.21 | A |
| Ex. 13 | 0.10 | 0.09 | 0.19 | A |
| Ref. Ex. 14 | 0.11 | 0.09 | 0.20 | A |
| Comp. Ex. 1 | 0.60 | 0.05 | 0.65 | C |
| Ex. 15 | 0.40 | 0.03 | 0.43 | B |
| Ex. 16 | 0.10 | 0.01 | 0.11 | A |
| Ex. 17 | 0.26 | 0.03 | 0.29 | A |
| Ex. 18 | 0.17 | 0.11 | 0.28 | A |
| Ex. 19 | 0.16 | 0.10 | 0.26 | A |
| Ex. 20 | 0.16 | 0.11 | 0.27 | A |
| Ex. 21 | 0.15 | 0.10 | 0.25 | A |

3. Maximum Coloring Density (ODmax Value)

TABLE 3

| | ODmax | Evaluation |
|---|---|---|
| Ex. 1 | 1.94 | B |
| Ex. 2 | 1.92 | B |
| Ex. 3 | 1.89 | C |
| Ex. 4 | 1.90 | B |
| Ex. 5 | 1.88 | C |
| Ref. Ex. 6 | 1.90 | B |
| Ex. 7 | 1.82 | C |
| Ex. 8 | 1.94 | B |
| Ref. Ex. 9 | 1.81 | C |
| Ref. Ex. 10 | 1.98 | B |
| Ex. 11 | 1.93 | B |
| Ex. 12 | 1.93 | B |
| Ex. 13 | 1.95 | B |
| Ref. Ex. 14 | 2.08 | A |
| Comp. Ex. 1 | 2.02 | A |

TABLE 3-continued

| | ODmax | Evaluation |
|---|---|---|
| Ex. 15 | 1.92 | B |
| Ex. 16 | 1.80 | C |
| Ex. 17 | 1.94 | B |
| Ex. 18 | 1.93 | B |
| Ex. 19 | 1.92 | B |
| Ex. 20 | 1.95 | B |
| Ex. 21 | 2.10 | A |

4. Stability of Intermediate Layer Coating Liquid

TABLE 4

| | Clouding duration | Evaluation |
|---|---|---|
| Ex. 1 | 1 hour | B |
| Ex. 2 | 1 hour | B |
| Ex. 3 | 1 hour | B |
| Ex. 4 | 1 hour | B |
| Ex. 5 | 1 hour | B |
| Ref. Ex. 6 | 3 days or longer | A |
| Ex. 7 | 40 minutes | B |
| Ex. 8 | 2 hours | B |
| Ref. Ex. 9 | 3 days or longer | A |
| Ref. Ex. 10 | 3 days or longer | A |
| Ex. 11 | 1 hour | B |
| Ex. 12 | 3 days or longer | A |
| Ex. 13 | 3 days or longer | A |
| Ref. Ex. 14 | 3 days or longer | A |
| Comp. Ex. 1 | 3 days or longer | A |
| Ex. 15 | 1 hour | B |
| Ex. 16 | 1 hour | B |
| Ex. 17 | 1 hour | B |
| Ex. 18 | 1 hour | B |
| Ex. 19 | 1 day or longer | A |
| Ex. 20 | 1 day or longer | A |
| Ex. 21 | 1 day or longer | A |

5. Color Tone

TABLE 5

| | a* | | b* | | |
|---|---|---|---|---|---|
| | Max (−) | Max (+) | Max (−) | Max (+) | Evaluation |
| Ex. 1 | −2.9 | 1.7 | 0 | 6.5 | B |
| Ex. 2 | −3.2 | 1.6 | 0 | 6.4 | B |
| Ex. 3 | −3.0 | 1.8 | 0 | 6.8 | B |
| Ex. 4 | −2.9 | 2.0 | 0 | 6.6 | B |
| Ex. 5 | −3.0 | 2.1 | 0 | 6.9 | B |
| Ref. Ex. 6 | −3.1 | 1.9 | 0 | 6.5 | B |
| Ex. 7 | −2.9 | 1.8 | 0 | 6.6 | B |
| Ex. 8 | −2.8 | 1.5 | 0 | 6.3 | B |
| Ref. Ex. 9 | −2.8 | 1.6 | 0 | 6.7 | B |
| Ref. Ex. 10 | −2.9 | 1.8 | 0 | 6.5 | B |
| Ex. 11 | −3.0 | 1.9 | 0 | 6.9 | B |
| Ex. 12 | −2.9 | 1.6 | 0 | 6.6 | B |
| Ex. 13 | −1.5 | 1.1 | 0 | 2.8 | A |
| Ref. Ex. 14 | −1.6 | 1.0 | 0 | 2.9 | A |
| Comp. Ex. 1 | −3.3 | 2.0 | 0 | 6.7 | B |
| Ex. 15 | −3.3 | 8.0 | 0 | 7.2 | B |
| Ex. 16 | −3.1 | 1.9 | 0 | 7.1 | B |
| Ex. 17 | −2.8 | 1.5 | 0 | 6.5 | B |
| Ex. 18 | −2.9 | 2.1 | 0 | 6.7 | B |
| Ex. 19 | −2.8 | 2.1 | 0 | 6.8 | B |

TABLE 5-continued

| | a* | | b* | | |
|---|---|---|---|---|---|
| | Max (−) | Max (+) | Max (−) | Max (+) | Evaluation |
| Ex. 20 | −1.5 | 1.4 | 0 | 2.4 | A |
| Ex. 21 | −1.6 | 1.5 | 0 | 2.8 | A |

6. Water Resistance and Chemical Resistance

TABLE 6

| | Coloring duration | Evaluation |
|---|---|---|
| Ex. 1 | 6 minutes | B |
| Ex. 2 | 6 minutes | B |
| Ex. 3 | 6 minutes | B |
| Ex. 4 | 8 minutes | B |
| Ex. 5 | 7 minutes | B |
| Ref. Ex. 6 | 8 minutes | B |
| Ex. 7 | 7 minutes | B |
| Ex. 8 | 8 minutes | B |
| Ref. Ex. 9 | 7 minutes | B |
| Ref. Ex. 10 | 8 minutes | B |
| Ex. 11 | 9 minutes | B |
| Ex. 12 | 7 minutes | B |
| Ex. 13 | 8 minutes | B |
| Ref. Ex. 14 | 60 minutes or longer | A |
| Comp. Ex. 1 | 6 minutes | B |
| Ex. 15 | 8 minutes | B |
| Ex. 16 | 8 minutes | B |
| Ex. 17 | 9 minutes | B |
| Ex. 18 | 6 minutes | B |
| Ex. 19 | 7 minutes | B |
| Ex. 20 | 8 minutes | B |
| Ex. 21 | 60 minutes or longer | A |

Evaluation results of the light resistance, moisture resistance, coloring density, stability of intermediate layer coating liquid, color tone, and water and chemical resistance are summarized in Table 7.

7. List of Results

TABLE 7

| | Image stability | | | Intermediate | | Water/ |
|---|---|---|---|---|---|---|
| | Light resistance | Humidity resistance | Coloring density | layer coating liquid stability | Color tone | chemical resistance |
| Ex. 1 | B | B | B | B | B | B |
| Ex. 2 | A | B | B | B | B | B |
| Ex. 3 | A | B | C | B | B | B |
| Ex. 4 | B | A | B | B | B | B |
| Ex. 5 | A | A | C | B | B | B |
| Ref. Ex. 6 | A | B | B | A | B | B |
| Ex. 7 | B | A | C | B | B | B |
| Ex. 8 | B | A | B | B | B | B |
| Ref. Ex. 9 | A | B | C | A | B | B |
| Ref. Ex. 10 | A | B | B | A | B | B |
| Ex. 11 | A | A | B | B | B | B |
| Ex. 12 | A | A | B | A | B | B |
| Ex. 13 | A | A | B | A | A | B |
| Ref. Ex. 14 | A | A | A | A | A | A |
| Comp. Ex. 1 | C | C | A | A | B | B |
| Ex. 15 | B | B | B | B | B | B |

TABLE 7-continued

| | Image stability | | | Intermediate | | Water/ |
|---|---|---|---|---|---|---|
| | Light resistance | Humidity resistance | Coloring density | layer coating liquid stability | Color tone | chemical resistance |
| Ex. 16 | B | A | C | B | B | B |
| Ex. 17 | B | A | B | B | B | B |
| Ex. 18 | B | A | B | B | B | B |
| Ex. 19 | B | A | B | A | B | B |
| Ex. 20 | B | A | B | A | A | B |
| Ex. 21 | B | A | A | A | A | A |

As seen from the results shown in Table 7, Examples of the present invention could achieve the excellent keeping quality (light and moisture resistance) of the image.

Since the thermosensitive recording material of the present invention has the similar recording density and coloring tone to those of silver halide printing paper, and is excellent in heat resistance and keeping quality, the thermosensitive recording material of the present invention can be used for various uses, such as recording materials for electronic computer, facsimile, facsimiles, ticket venders, scientific computers, CAD printers, plotters, and printers for CRT-based medical measurements, and is especially suitably used as a thermosensitive recording material for medical images.

What is claimed is:

1. A thermosensitive recording material, comprising:

a base;

a thermosensitive recording layer disposed on the base, and containing a leuco dye and a color developer;

an intermediate layer disposed on the thermosensitive recording layer; and a protective layer disposed on the intermediate layer, wherein the intermediate layer contains a resin, and an aziridine compound, and the resin contained in the intermediate layer includes a polyamine resin, or a polyamide resin, or both a polyamine resin and a polyamide resin, and wherein the intermediate layer further contains polyvinyl alcohol.

2. The thermosensitive recording material according to claim 1, wherein the thermosensitive recording layer contains at least one selected from the group consisting of a polyamine resin and a polyamide resin.

3. The thermosensitive recording material according to claim 1, wherein the aziridine compound contains at least two functional groups per molecule.

4. The thermosensitive recording material according to claim 1, wherein an amount of the aziridine compound in the intermediate layer is 15 parts by mass to 30 parts by mass relative to 100 parts by mass of the resin contained in the intermediate layer.

5. The thermosensitive recording material according to claim 1, wherein an amount of the polyamine resin, or the polyamide resin, or both thereof in the intermediate layer is 10 parts by mass to 40 parts by mass relative to 100 parts by mass of the resin contained in the intermediate layer.

6. The thermosensitive recording material according to claim 1, wherein the polyvinyl alcohol is carboxylic acid-modified polyvinyl alcohol.

7. The thermosensitive recording material according to claim 1, wherein the leuco dye in the thermosensitive recording layer contains a black coloring leuco dye, a red coloring leuco dye, and a blue coloring leuco dye.

8. The thermosensitive recording material according to claim 1, wherein the protective layer contains an acrylate resin which is cured by UV or electron beam radiation.

9. The thermosensitive recording material according to claim 1, further comprising a back layer.

10. A method for producing a thermosensitive recording material, comprising:

applying an intermediate layer coating liquid containing an ammonium aqueous solution onto a thermosensitive recording layer so as to form an intermediate layer, wherein the thermosensitive recording material comprises:

a base;

the thermosensitive recording layer disposed on the base, and containing a leuco dye and a color developer;

the intermediate layer disposed on the thermosensitive recording layer; and a protective layer disposed on the intermediate layer, wherein the intermediate layer contains a resin, and an aziridine compound.

* * * * *